United States Patent [19]

Doane

[11] Patent Number: 4,819,944

[45] Date of Patent: Apr. 11, 1989

[54] GOLF CLUB SWING TRAINING DEVICE

[76] Inventor: James J. Doane, 112 Bombay Avenue, Downsview, Ontario, Canada, M5H 1C3

[21] Appl. No.: 217,093

[22] Filed: Jul. 8, 1988

Related U.S. Application Data

[63] Continuation of Ser. No. 11,473, Feb. 5, 1987, abandoned.

[51] Int. Cl.[4] ..... A63B 69/36

[52] U.S. Cl. ..... 273/193 A; 273/194 R; 273/81 D; 273/81.3

[58] Field of Search ..... 273/165, 81 D, 193 R, 273/194 R, 193 A, 193 B, 194 A, 194 B, 186 A, 81.3

[56] References Cited

U.S. PATENT DOCUMENTS 760,161 5/1904 Smith ..... 273/165

2,938,728 5/1960 Green ..... 273/81 D

OTHER PUBLICATIONS

Golf Magazine, Jun. 1983, pp. 92 & 93 (copy attached).

*Primary Examiner*—George J. Marlo

*Attorney, Agent, or Firm*—Arne I. Fors; Robert F. Delbridge

[57] ABSTRACT

A golf exercise device has a shaft with a grip at one end and a weight in the other, and a second lower grip parallel to the first, attached to the shaft between the first grip and the weight, offset from the first grip. By swinging the invention in a swing similar to that of a golfer, the correct muscle memory is built up to enable the golfer to swing a golf club in a natural and correct manner.

1 Claim, 1 Drawing Sheet

GOLF CLUB SWING TRAINING DEVICE

This application is a continuation of application Ser. No. 011,473, filed Feb. 5, 1987 (now abandoned).

This invention relates in general to a golf exercise device having a shaft with a grip at one end and a weight on the other, and a second grip parallel to the first, attached to the shaft between the first grip and the weight, offset from the first grip.

The invention is designed primarily to allow a golfer to exercise all of the correct muscles groups used in the golf swing while developing the muscle memory relating to a sound, correct, natural and repeating swing motion. While the invention may be used in almost any place, it is intended for use indoors in confined space without the necessity of hitting a ball during periods when the actual playing of the game is not possible. It may also be used as a teaching aid as well and be produced in the form of an actual club for use on the practice tee.

The golf swing is notoriously difficult for a beginner to learn and the average golfer to maintain. The single shafted conventional golf club is grasped with both hands together one below the other and can easily be manipulated by pronation and supination (rolling) of the wrists and arms virtually in the same manner as if the club is grasped with either hand alone uncontrolled. The pronation and supination, in the hands of a beginner or average golfer, result in the club face meeting the ball at various angles, causing mishit shots. This invention virtually eliminates this uncontrolled motion with the result that the club face remains basically square throughout the swing.

There have been suggestions at various times to manufacture golf clubs with two, parallel, grips in an attempt to overcome the difficulties experienced by beginners in the game.

U.S. Pat. No. 1,919,221 (Inventor: Janes), for instance, shows (inter alia) a golf club having two handles of equal length in basically a 'Y'-shaped pattern with the two handles close together, designed so that a player could use both hands, beside and close to each other. However, that device would not inhibit wrist rotation significantly as the grips are placed too closely together and with handles of equal length would not put the players shoulders, arms and hands in the same position as with a normal club. Another difficulty with the device is that under the rules of golf, it would be illegal to use a two-handed club in a golf game; yet this is advocated in the patent. The purpose of the device was to replace the legal golf club with a new, easier to use, but currently illegal club —thus the device did not have to be designed in a way that facilitates an easy transition by a golfer from a two-handed to a single-handed club.

Another device shown in U.S. Pat. No. 2,938,728 (Inventor: Green) includes an auxillary handle which has two clamps enabling it to be attached to a golf club handle, in the form of a "P", and is meant to weaken the action of the right hand during the swing. However, because of the two clamps the result was a closed loop, with the upper bracket interfering with both the hands when in use. The upper bracket would interfere with (a) the lower hand because it cannot be placed at the proper angle and (b) the upper hand, because it is forced to a position too far above the lower hand and as a result the lower hand cannot be placed on the auxilary handle properly. The device was meant to weaken the right hand in the golf swing; it does not permit an easy transition to a normal club because it prevents the hands from being placed in the same relative position as with the normal, single shafted club.

This invention generally relates to a training device for golf, comprising a shaft terminating at one end with a weight and at the other with a first grip, a crosspiece extending perpendicular to the shaft, and a second grip extending parallel to the first grip from the crosspiece; the distance between the two grips being between 3" and 4" measured from their centres which with regular use (a) develops the muscles used in the golf swing and (b) produces muscle memory relating to a sound repeating golf swing, while (c) facilitating the transition to the normal golf club.

Referring to the drawings, in which like numbers refer to like parts throughout:

Figure 1:
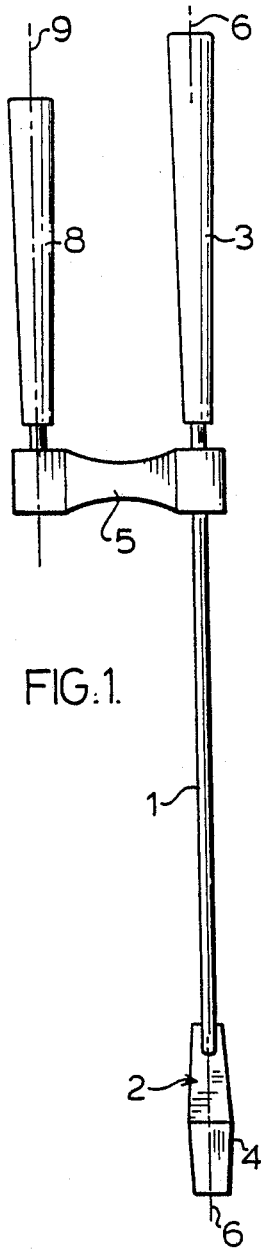
FIG. 1 is an elevation of an embodiment of the invention, viewed from the front.
Figure 2:
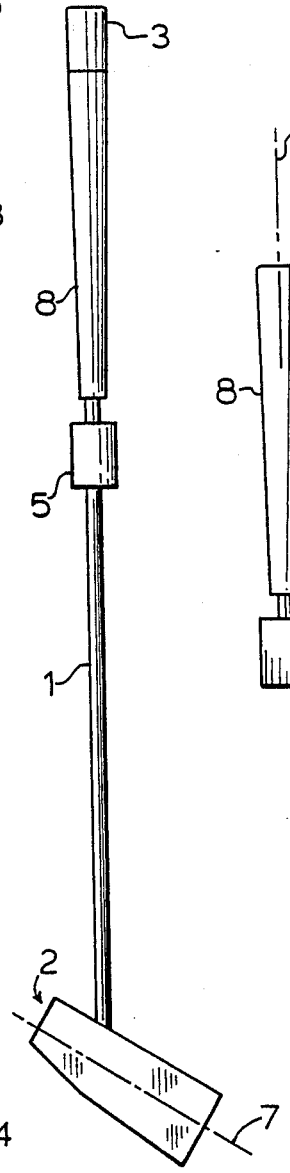
FIG. 2 is an elevation of the same embodiment viewed from the side.

The embodiments shown consists of a shaft 1, terminating at one end in a weight 2 and at the other in a first grip 3. The weight has a front surface 4. Between the weight 2 and the grip 3 is attached a lateral crosspiece 5 which is generally perpendicular to the longitudinal axis 6 of the shaft 1 in a first plane and generally perpendicular to a second plane defined by the longitudinal axis 7 of the weight and the longitudinal axis 6 of the shaft 1. A second grip 8 having a longitudinal axis 9 extends upwardly as shown in the drawing from the crosspiece 5 generally parallel to shaft 1 and thus falls within the plane common to crosspiece 5 and axis 6 of shaft 1.

In the embodiments shown, the second grip 8 terminates lower than the first grip, so that the right hand is guided to a position lower than the left. This arrangement should be reversed for a left-handed player.

Figure 3:
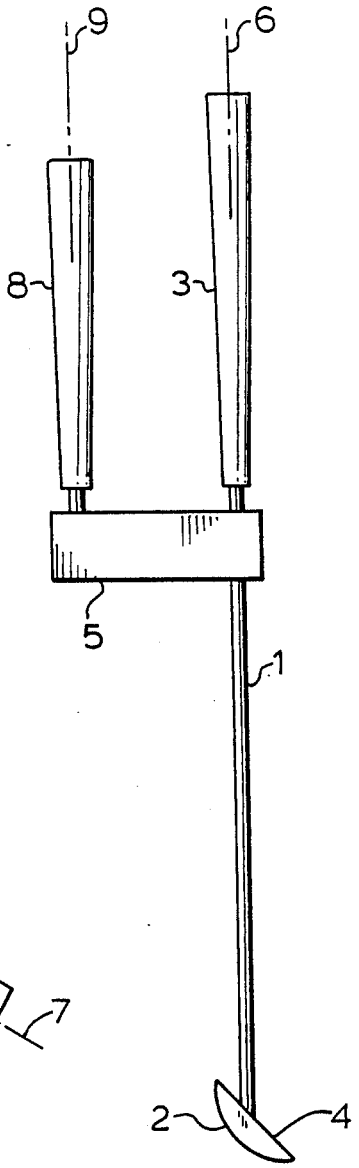
FIG. 3 is a perspective view of an embodiment of the invention having a weight with the configuration of a golf club head.

The embodiment shown in FIG. 3 has the weight in the configuration of a golf club head, with a striking face on the front surface 4 similar to that of a golf club, with the equivalent angle.

The device can be made in a variety of ways from a variety of materials. It can be made in one piece or several pieces but the following should pertain:

1. The swing weight should be equal to or exceed the weight of an average 5 iron and the device should be approximately 25" in length.

2. The position of the weight may be variable or fixed but its center of gravity should be in the plane defined by axis 6 of shaft 1 and axis 7 of weight 2, and thus always remain perpendicular to the front face of the crosspiece.

3. The grips must be substantially parallel and be 3" or more apart, preferably about 3"–4" measured between their axes and be permanently affixed to the shaft and the crosspiece.

4. The second grip should end about 2"–3" below the end of the other.

5. The crosspiece and the shafts are permanently affixed to each other.

The above should result in a device proportioned to guide a beginner in his swing and assist the average golfer in maintaining his swing during periods when the actual playing of the game is not possible.

The device is used by swinging it the same arc as a single shaft golf club would be swung, as described more particularly below. The device, with regular use, enables the beginner to develop muscle "memory", and the average golfer to reinforce "memory", of the correct swing; and when he uses a golf club he will find that he tends to follow the same correct swing as he was constrained to follow by this exercise device.

This invention allows and encourages the golfer to execute a motion akin to a two-handed, underhanded tossing or throwing motion utilizing both hands approximately equally during the swing.

This invention is used as follows, when the user adopts a normal golfing stance:

1. The device of the invention has one grip about 2"–3" lower than the other (the right hand grip for right handed players and the left for left handed players) spaced at least 3" apart, preferably about 3"–4" measured at the parallel axes of the grips. The user therefore puts his shoulders and hands in the same position or "set" as they would be with a single shaft golf club.

2. When the device is taken back to begin the swing, the hands, arms and wrists cannot easily rotate the weight and this lack of manipulation keeps the weight front in an approximately square position throughout the backswing, the grips being spaced far enough apart to substantially prevent the hands from manipulating the device improperly.

3. When the device is swung forward, the leading hand is always followed by the trailing hand and both remain in the same plane defined by axes 6 and 9 and lateral crosspiece 5, which is substantially the plane of the swing, so that the angle of the weight front again remains substantially square throughout the downswing.

4. Because the device puts the shoulders, arms and hands in the same relative position as with a single shaft golf club and is not subject to hand manipulation during the swing, the swing plane cannot easily change and the swing pattern tends to remain constant, natural and correct.

5. The position of the hands forces the body and arms to rotate naturally, resulting in properly coordinated body weight transfers both on the backswing and the downswing.

6. The position of the weight front 4 and angle (equivalent to a club face and angle in the embodiment shown in FIG. 3) in relation to the hands and arms is apparent to the user because the perpendicularity of the end weight to the crosspiece is always visible.

7. The design of the device, particularly with one grip shorter than the other, facilitates the transition from use of the device to use of a normal golf club, in which one hand is slightly lower than the other.

It will be evident to the person skilled in the art that modifications may be made to the device without departing from the spirit of the invention.

What I claim as new and desire to protect by Letters Patent of the United States is:

1. A training device for golf comprising a shaft having a longitudinal axis terminating at one end with a weight having a front surface and a longitudinal axis and terminating at the other end with a first grip, a single lateral crosspiece permanently affixed to the shaft below the first grip extending laterally from the shaft defining a first plane perpendicular to a second plane defined by the longitudinal axis of the weight and the longitudinal axis of the shaft, a second grip terminating lower than the first grip by about 2–3 inches and having a longitudinal axis extending upwardly from the crosspiece parallel to the first grip and spaced from the longitudinal axis of the first grip in the said first plane by about 3–4 inches, the crosspiece being in the said first plane on a side of the shaft opposite to the front surface of the weight, whereby swinging of said training device on a backswing and downswing simulates the swinging of a single shaft golf club while maintaining the front surface of the weight substantially perpendicular to the plane of the swing.

* * * * *